US005953944A

United States Patent [19]

Groening et al.

[11] Patent Number: 5,953,944

[45] Date of Patent: Sep. 21, 1999

[54] IN-LINE WIRE DRAWING CONTINUOUS TREATMENT PROCESS

[75] Inventors: Manfred Groening, Summerville, S.C.; Heinz-Juergen Wiedenbruch; Karl-Heinrich Radix, both of Schwerte, Germany

[73] Assignee: American Precision Steel Company LP, Summerville, S.C.

[21] Appl. No.: 09/001,480

[22] Filed: Dec. 31, 1997

[51] Int. Cl.[6] ..... B21C 43/02

[52] U.S. Cl. ..... 72/40; 72/42; 72/282

[58] Field of Search ..... 72/40–43, 274, 72/278, 282

[56] References Cited

U.S. PATENT DOCUMENTS

| | | | |
|---|---|---|---|
| 2,966,425 | 12/1960 | Fucinari | 72/40 |
| 4,099,399 | 7/1978 | Berry | 72/40 |
| 4,286,449 | 9/1981 | Spreafico | 72/40 |
| 4,329,861 | 5/1982 | Griffiths | 72/43 |
| 4,545,227 | 10/1985 | Sudoh | 72/40 |
| 4,553,416 | 11/1985 | Sudoh | 72/40 |
| 5,201,206 | 4/1993 | Russo | 72/40 |

FOREIGN PATENT DOCUMENTS

| | | | |
|---|---|---|---|
| 212441 | 8/1993 | Japan | 72/40 |
| 608576 | 5/1978 | Russian Federation | 72/40 |

*Primary Examiner*—Daniel C. Crane
*Attorney, Agent, or Firm*—Barry G. Magidoff; Paul Sutton; Gerard Wissing

[57] ABSTRACT

A continuous in-drawing line process and system for drawing stainless steel wire is provided wherein wire is (1) brushed in an inlet brush station to remove oxide film from the wire surface; (2) coated with a lubricant carrier coating which is dried then subsequently cooled; (3) drawn through a drawing machine using a lubricant; and (4) brushed to remove residual carrier compounds from the surface of the drawn wire. The system for carrying out this process includes a wire payoff; an inlet brush station having two pairs of brushes that rotate in a direction opposite to that of the wire to remove oxide film therefrom; a coating device; a dryer; a cooler; a drawing machine; first and second outlet brush stations each having two pairs of brushes that rotate in a direction opposite to that of the wire to remove residual drawing compounds therefrom; and a wire take-up device.

9 Claims, 6 Drawing Sheets

IN-LINE WIRE DRAWING CONTINUOUS TREATMENT PROCESS

BACKGROUND OF THE INVENTION

1. Field of the Invention

The present invention relates to a continuous in-line treatment process for wire drawing. More specifically, the invention relates to a continuous in-line dry brush treatment process for removing an oxide film from stainless steel rod or wire prior to drawing, continuous coating procedure for applying of lubricant carrier, and a post drawing brushing stage for removing residual drawing compounds comprising carrier coating and lubricant from the drawn wire.

2. Related Art

Conventional means for descaling rod or wire, or removing oxide from stainless steel wire, before drawing, typically include either passing the wire through a "pickling" tank containing acid, or, in the case of non-stainless steel, either passing the wire through a "pickling" tank containing acid, or mechanically descaling the wire by bending it or blasting it with abrasive particles. The wire is then coated with a lubricant and drawn. Once the wire is drawn, excess lubricant coating and any scale is removed from the wire according to conventional degreasing processes.

For example, U.S. Pat. No. 4,553,416 to Sudoh et al. is directed to a dry type continuous wire drawing process. Under this process, a steel wire to be drawn is mechanically descaled, coated with a lubricant and drawn through a drawing die. Mechanical descaling is achieved by passing the wire through a shot blaster, wherein shot particles are directed at the wire to remove any oxide film therefrom. Alternatively, a roll bender may be used to repeatedly bend and elongate the wire so that the scale layer is fissured and can be peeled off.

U.S. Pat. No. 5,201,206 to Russo discloses a continuous wire drawing process in which a mechanical descaler bending of the stock is used to remove scale from alloy steel wire prior to drawing and a buffer unit is used to remove carrier and lubricant by buffing with a plurality of buffer wheels.

U.S. Pat. No. 3,320,701 to Abrams et al. discloses a method for treating metal in connection with cold reduction operations using abrasive blast cleaning units for directing abrasive media against the upper and lower surfaces of a piece of metal.

U.S. Pat. No. 2,335,196 to Pecsok discloses a method for removing scale from metal sheets by passing a sheet through (1) a water spray to loosen the scale, then (2) a pair of breaker rolls that flex the sheet to aid in breaking up the scale into particles, then (3) a brushing station to lift and pick off the scale particles.

These conventional pickling and degreasing methods create hazardous conditions and can have an extremely detrimental impact on the environment and require high investment and process costs. In addition, mechanical descaling involving bending such as that disclosed in U.S. Pat. No. 2,335,196 to Pecsok is inapplicable to stainless steel wire because the thin layer of oxide film that forms on stainless steel wire is ductile and therefore cannot be removed by such mechanical descaling processes.

SUMMARY OF THE INVENTION

It is therefore an object of the present invention to provide a continuous in-line dry brush treatment process for cleaning rod or wire, in particular stainless steel wire rod, prior to drawing and for removing residual drawing compounds, comprising coating and lubricant, from the drawn wire after drawing, which eliminates the hazardous waste and negative environmental impact associated with conventional liquid-based methods and is less expensive than such methods.

It is also an object of the present invention to provide a continuous in-line dry brush stock cleaning and continuous coating of lubricant treatment system for carrying out the invention process, and specifically to provide inlet and outlet brush stations and an efficient continuous coating bath for use in carrying out the process.

It is a further object of the present invention to provide drawn stainless steel wire products prepared according to the continuous in-line dry brush treatment process of this invention.

According to the present invention, these objectives are achieved through the use of a continuous treatment system for cleaning the coating the wire or wire rod stock by first providing wire brushes having carefully defined parameters of construction and materials for the pre- and post-treatment of drawn wire rod. Specifically, an inlet brush station is employed to remove the thin oxide film from stainless steel wire and to clean and activate the surface of the wire in preparation for the application of a lubricant carrier coating prior to drawing. This pre-coating and pre-drawing dry brush step eliminates the need for conventional chemical pickling methods and their attendant environmental hazards, and is surprisingly less costly (as to both investment and operation) than such prior methods.

The wire is then continuously coated with a lubricant carrier coating in a shallow bath, and dried to achieve a smooth coating, further coated with a lubricant, and drawn through a conventional drawing machine, using a lubricant such as calcium stearate. Preferably, the coated wire is dried by being passed through a dryer to dry the lubricant carrier coating, passed through a cooler to cool the wire, and the lubricant is applied immediately prior to being passed through rotating and pressure dies, which preferably are used to enhance the drawing function. Next, the stainless drawn wire is passed through first and second outlet brush stations, where any residual drawing compounds (carrier coating plus lubricant) are removed from the wire preferably using a modified, less abrasive brush arrangement. This post-drawing brushing step reduces, and preferably eliminates the need for conventional degreasing methods and their attendant environmental hazards, and is, again, surprisingly less costly than such prior art methods.

BRIEF DESCRIPTION OF THE DRAWINGS

The invention is better understood by reading the following Detailed Description of the Preferred Embodiments, with reference to the accompanying drawing figures, in which like reference numerals refer to like elements throughout, and in which.

DETAILED DESCRIPTION OF THE PREFERRED EMBODIMENTS

Figure 1:
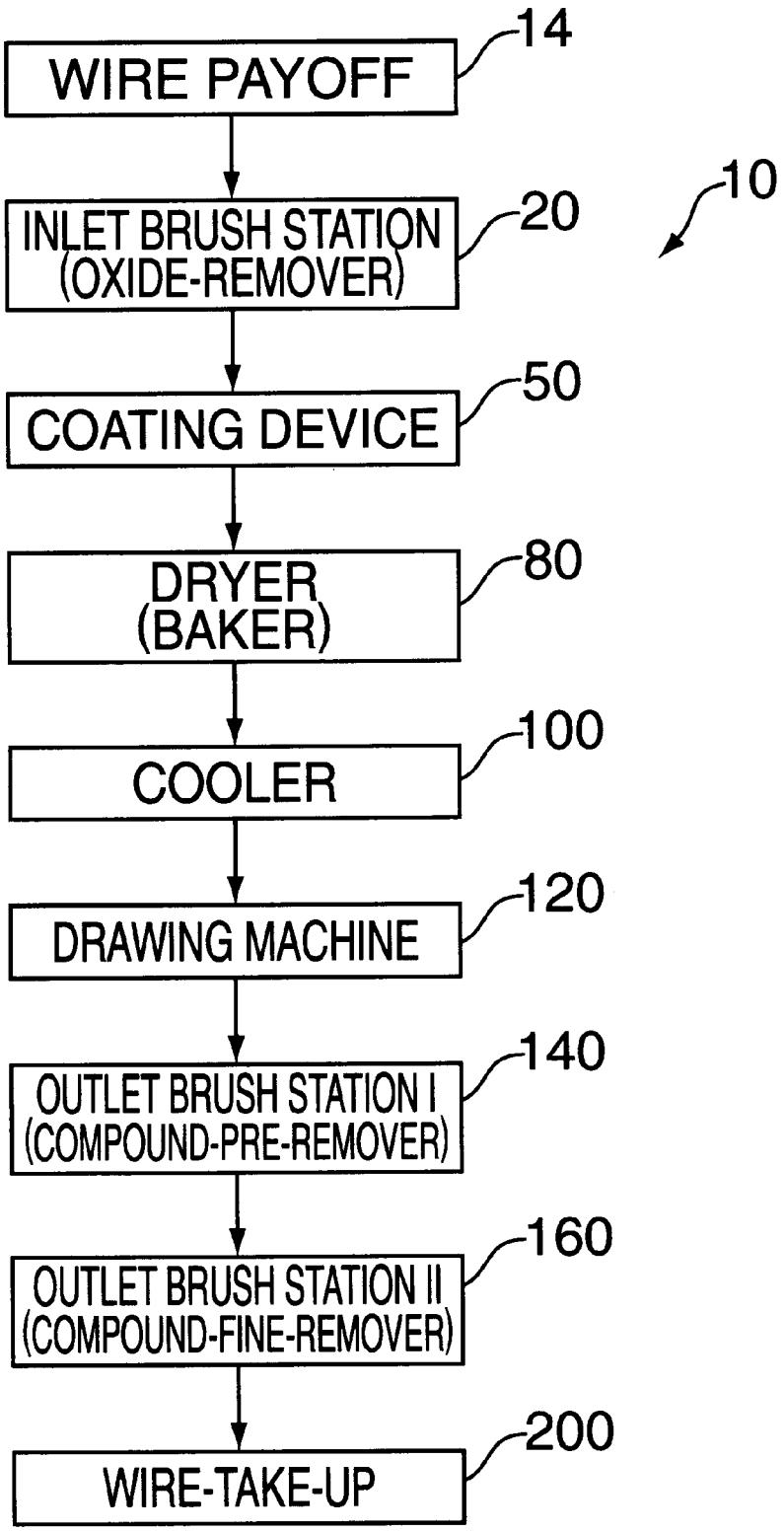
FIG. 1 is a block flow diagram of the process of this invention.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

Figure 2:
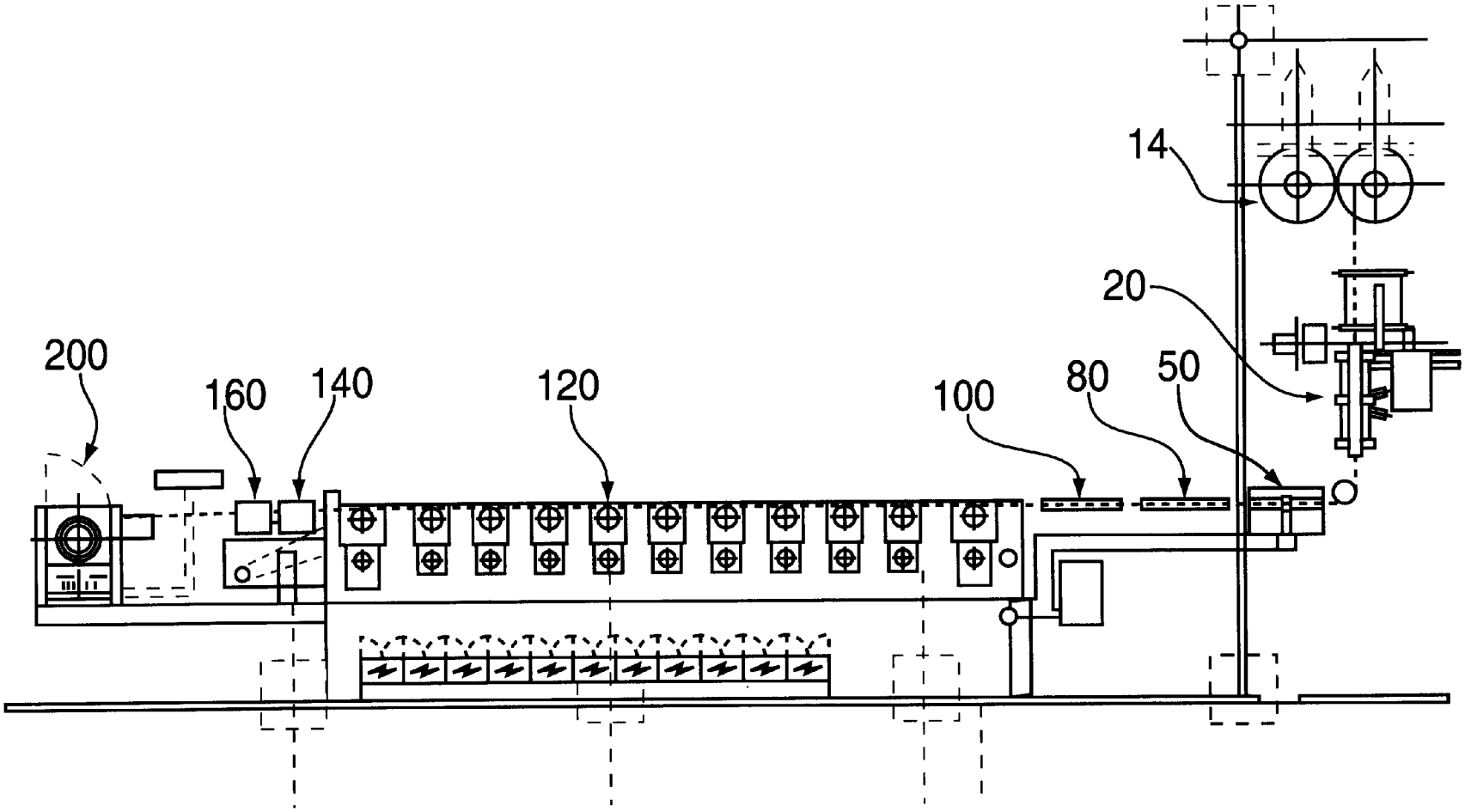
FIG. 2 is a schematic top plan view of one embodiment of the apparatus for carrying out the process of the invention.

As illustrated by the embodiment shown in FIGS. 1 and 2, the process of this invention comprises a continuous process for cleaning, coating and drawing and cleaning stainless steel wire or wire rod 12 in an in-line system preferably comprising the steps of (1) providing wire rod 12 from a continuous wire payoff 14 to an inlet brush station 20; (2) removing oxide film from the wire rod 12 by passing it through inlet brush station 20; (3) passing wire rod 12 through a coating device 50 to coat wire rod 12 with a lubricant carrier coating; (4) preferably passing the wire rod 12 through a heated dryer 80 to dry the coating; (5) preferably passing wire rod 12 through a cooler 100 to cool the dried wire; (6) applying a lubricant and drawing the lubricant-coated wire rod 12 by passing it through a series of dies in a drawing machine 120, preferably a powdered lubricant is applied adjacent each die; (7) removing remaining residual lubricant coating from the surface of the drawn wire 12 by passing it through first and second outlet, medium and fine bristle, brush stations 140, 160; and (8) passing the drawn wire 12 to a conventional wire take-up device 200 for winding on stripper blocks, spoolers or other devices for shipping or further processing.

With reference to FIG. 2, depending on the length of drawing machine 120 and available floor space, it is possible to reduce the overall length of the system 10 by redirecting the wire rod, e.g., between inlet brush station 20 and coating device 50, by bending the brushed wire 12 around a standard redirecting wheel 21.

The stainless steel wire rod 12 is preferably selected from AISI 200/300/400 and PH-grades and the like. The wire rod is conventionally pre-treated by the raw material supplier to a desired finish (e.g., usually by being pre-pickled and passivated), which is standard for the raw material supplied to the stainless steel wire drawing shops; in addition, this invention can also be used in the further treatment of heat-treated wire from an earlier reduction process, where an oxide film or a color scale, is formed by annealing. In both cases, the wire or wire rod has a passive, extremely thin surface film to protect the wire against further corrosion; the thin surface film is firmly adherent to the metal surface and thus gives the appearance of being ductile. The oxide film needs to be removed for better lubricant coating adhesion (to provide mechanical activation of, and cleaning of, the surface of the wire). The thin ductile layer of oxide film naturally forms on the surface of such grades of stainless steel wire, but is enhanced by passivating processes (increasing protection during shipping and storage). In all such cases, the firm adhesion and effective ductility of this oxide film layer renders it incapable of being removed by conventional mechanical descaling devices.

In contrast, non-stainless steel does not form a passivating film, rather the scale that forms on non-stainless steel (carbon and alloy steel) is not passivating, and is generally brittle and non-ductile; therefore it was early recognized that it can be removed using mechanical descaling devices.

The incoming wire rod 12 preferably has a diameter of less than 15 mm (0.5905 inch), whereas previously drawn wire can be as thin as 1 mm (0.0394).

Wire rod 12 is supplied to the treatment system 10 from, preferably, joined coils through wire payoff 14. Wire payoff 14 is a conventional continuous wire payoff with successive coils of wire rod joined by, e.g., welding, to avoid set-up times after processing of each coil of wire rod 12.

The wire rod 12 from payoff 14 is fed to inlet brush station 20, wherein a pre-drawing, pre-coating dry brushing step is performed to remove the ductile oxide film and any superficial light rust from the surface of the wire 12, thereby cleaning and activating the surface of wire 12 in preparation for application of a lubricant carrier coating. This pre-drawing brushing step replaces previously used conventional pickling processes, and eliminates the environmental hazards and high costs associated therewith.

To control the alignment of, and pull-back tension on, the wire rod 12, and to prevent wire vibrations, a conventional roll straightener (not shown) is preferably placed upstream of the inlet brush station 20, and wire guides 40 (discussed in detail below) are placed in front of and behind each of the first and second pairs of brushes 22*a*, 22*b* and 24*a*, 24*b*. The roll straightener is preferably a standard roll straightener having a minimum of five straightener rolls.

Figure 3:
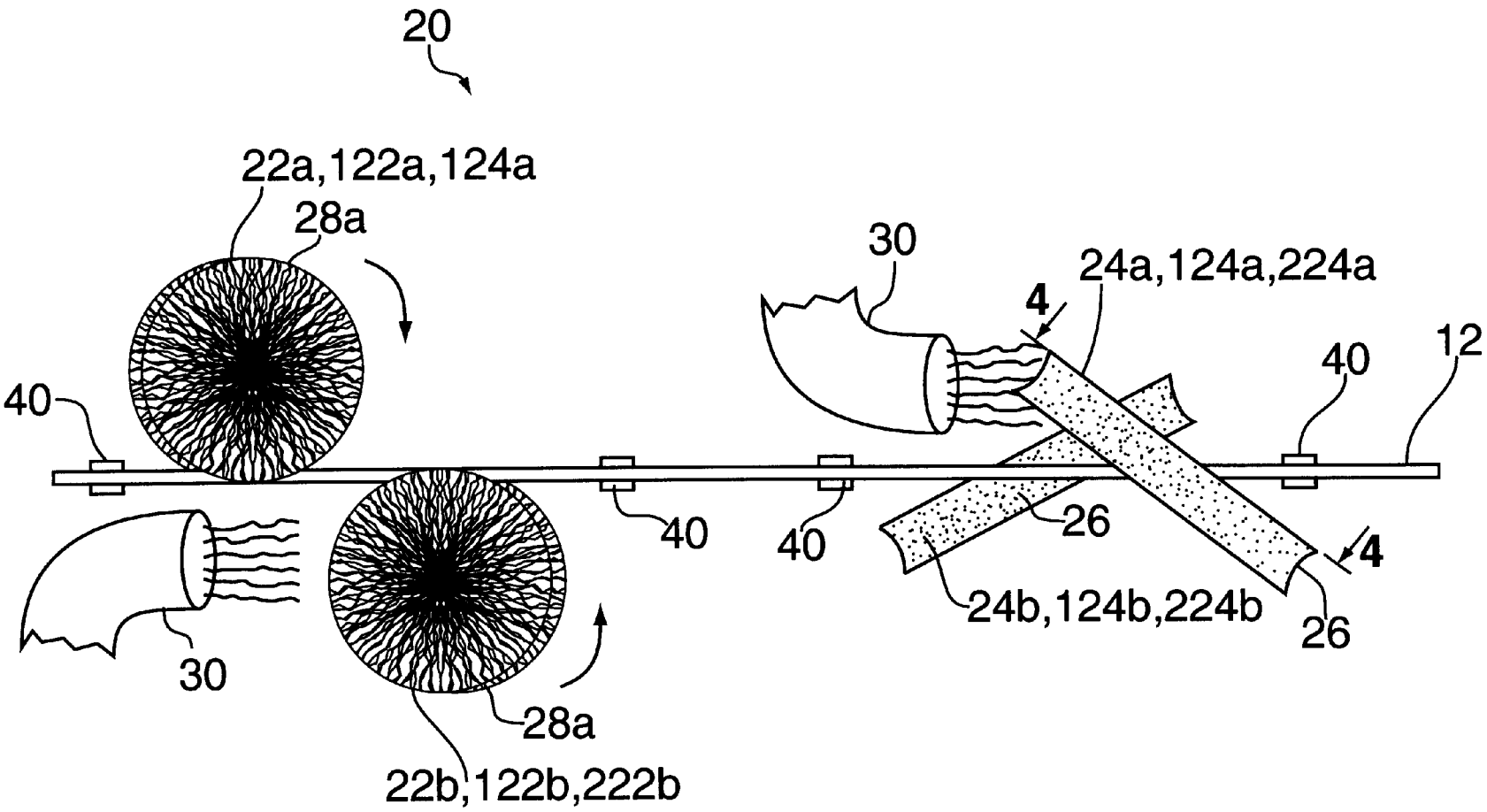
FIG. 3 is an enlarged schematic view of one embodiment of the brush stations of FIG. 2 of this invention.

As illustrated in FIG. 3, the inlet brush station 20 houses a first pair of brushes 22*a*, 22*b* and downstream a second pair of brushes 24*a*, 24*b*; the drive shafts (and axes of rotation) of the first pair of brushes 22*a*, 22*b* are parallel to each other, and the drive shafts 26*a* (and axes of rotation) of the second pair of brushes 24*a*, 24*b* are also parallel to each other. The drive shafts 26*a* of each of the second pair of brushes 24*a*, 24*b* are perpendicular to the drive shafts 26 of the first pair of brushes. One or more vacuum nozzles 30 are located adjacent to each of the first and second pairs of brushes 22*a*, 22*b*, 24*a*, 24*b* and plastic wire guides 40, are located in front of and behind each pair of brushes 22*a*, 22*b* and 24*a*, 24*b*. First and second pairs of brushes 22*a*, 22*b*, 24*a*, 24*b* are preferably arranged at a 90° angle to each other and at an angle of about 20° relative to the wire rod 12, to ensure that the entire surface of wire rod 12 is scrubbed by the brushes 22*a*, 22*b*, 24*a*, 24*b*, as the wire moves past them.

The brushes 22*a*, 22*b*, 24*a*, 24*b* are electrically powered and preferably rotate in a direction opposite to the wire motion direction, to maximize removal of oxide and dirt. Preferably, each brush 22*a*, 22*b*, 24*a*, 24*b* is individually controlled by a pneumatic pressure ram (not shown) to apply a desired pressure against the wire rod surface 12. Alternatively, hydraulic or mechanical pressure rams may be used to exert the forces against the brushes 22*a*, 22*b*, 24*a*, 24*b*. The power consumption of the motor (not shown) that drives the brushes (measured in terms of electric current) increases with increasing brush pressure against the wire 12. Thus, the power consumption (or current) of the motor can be adjustable to maintain rotational speed of the brushes to permit optimization of brush pressure and speed on the wire rod 12. The optimum brush pressure and oxide film removal depend upon the desired oxide removal level and is obtained by empirical experience about surface cleanliness and coating adhesion. A common procedure to permit visual checking that the entire surface of the wire was brushed is to paint the surface prior to brushing, and then confirming that the paint has been fully removed.

Specifically, each brush 22*a*, 22*b*, 24*a*, 24*b* is adjusted as to the perpendicular force exerted against the surface of the wire rod 12 by a pneumatic swivel ram (not shown) acting against the brush axle 26, 26*a*, until the desired empirical cleaning and brushing effect is achieved. Brushes 22*a*, 22*b*, 24*a* and 24*b* can be adjusted to obtain optimal oxide film removal by varying wire rod speed and brush speed and pressure; it has been found that this may be measured as the ratio of the electrical current drive during idle brush operation (brush rotates without brushing load), I (idle), relative to the electric current drawn during loaded brush operation, I (load), for rotating the brushes. The higher the electrical current I (load), the greater the brush effect.

Figure 4:
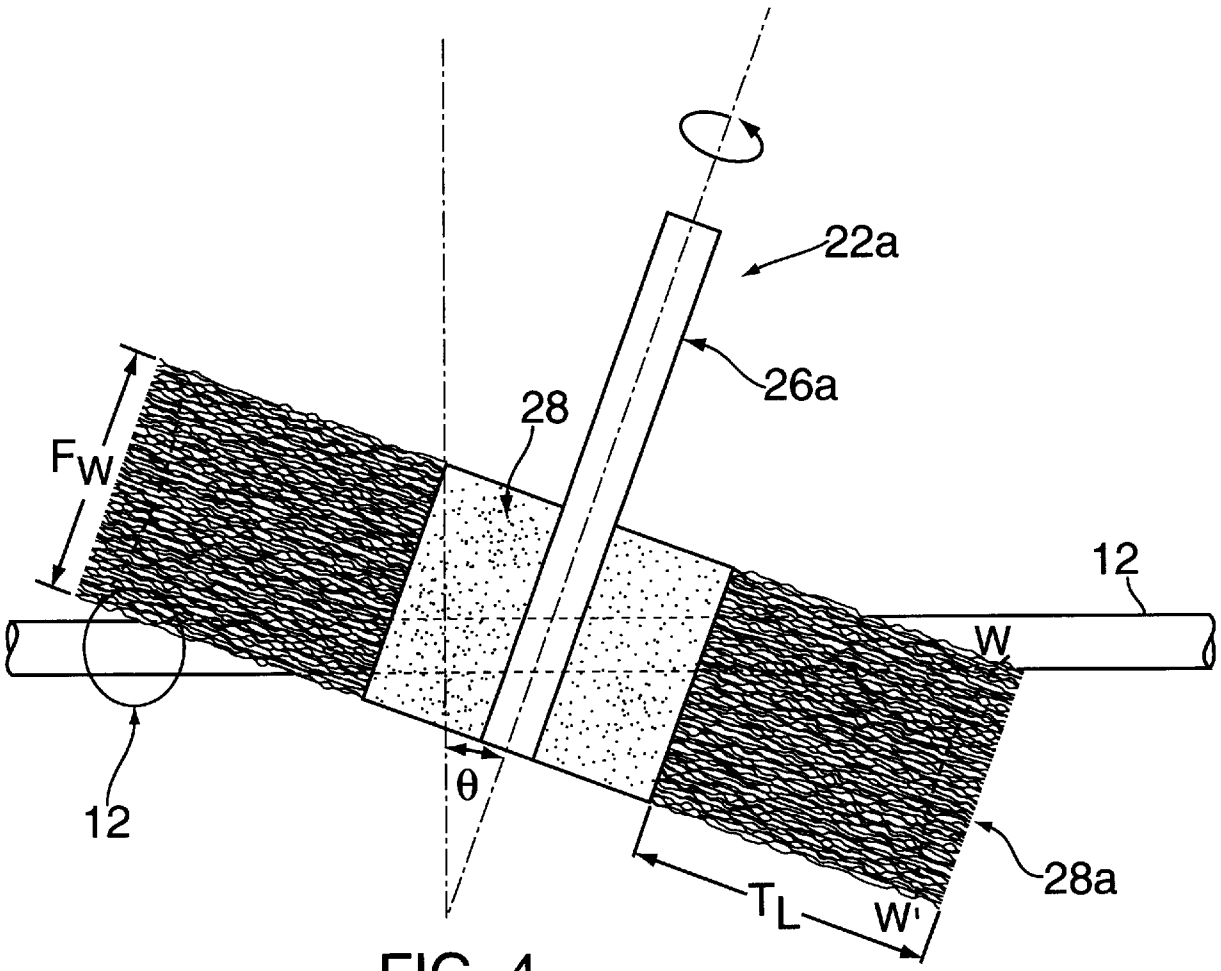
FIG. 4 is a cross-section view of a brush of FIG. 3, taken along lines 4—4.

As shown in FIG. 4, each brush 22*a*, 22*b*, 24*a*, 24*b* includes a drive axle shaft 26 inserted in the center of a cylindrical brush body 28 having bristles 28*a* extending radially outwardly therefrom. Bristles 28*a* are preferably made of stainless steel material having a composition similar to that of the wire rod 12 to be brushed, to avoid any galvanic corrosion caused by possible bristle residuals on the wire. Preferred wire/bristle combinations for highly exacting situations, where avoiding all galvanic corrosion of the wire rod 12, requires that the grade of the stainless steel wire rod 12 be the same grade as the stainless steel brush bristles 28*a*.

Preferably, the speed of rotation of the brushes 22*a, b*, 24*a, b*, is in the range of about 2500 to about 4500 rpm, the brush outside diameter is in the range of from about 150 to about 300 mm, the brush face width (FW) is in the range of from about 15 to about 60 mm; brush trim length (TL) is in the range of from about 25 to about 75 mm, bristle 28*a* diameter is in the range of from about 0.20 to about 0.50 mm and the bristle wire hardness is fully hard.

Figure 5:
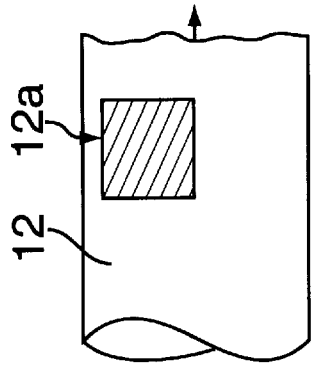
FIG. 5 is a schematic enlarged view of Detail A of FIG. 4 showing brush scratch texture on the surface of wire rod, created as the wire rod passes through the inlet brush station of this invention.

As discussed above and illustrated in FIG. 4, the axis of rotation of each of the brushes 22*a*, 22*b*, 24*a* and 24*b* are preferably arranged at an angle θ of preferably about 20° to the longitudinal axis of the wire 12. This arrangement allows for more uniform effect of the brush over the entire surface of wire 12 and during use creates a curved wear surface over brush face width FW, resulting in greater contact area between the brush face (i.e., the ends of the individual bristles) with the wire surface during use (see the schematic wear profile geometry, shown as a dashed line W.W in FIG. 4) in comparison with a shaft 26 position that is perpendicular, or parallel to the longitudinal axis of the wire rod 12. As bristles 28*a* of brushes 22*a*, 22*b*, 24*a*, 24*b* remove the oxide layer and brush the surface of the wire rod 12, they create a slight wire surface brush scratch pattern 12*a* as shown in FIG. 5. The brush scratch pattern 12*a* is in a transverse direction to the wire drawing direction; it improves adhesion of the carrier coating applied in the coating device 50 and of drawing lubricant.

Vacuum nozzles 30 are connected to one or more vacuum exhausts (not shown) and are located immediately adjacent the contact surface between the wire rod 12 and the respective pair of brushes 22*a*, 22*b*, 24*a*, 24*b*, as illustrated in FIG. 3, to remove oxide film particles scrubbed from the wire rod 12 by the first and second pairs of brushes 22*a*, 22*b*, 24*a*, 24*b*.

Figure 6:
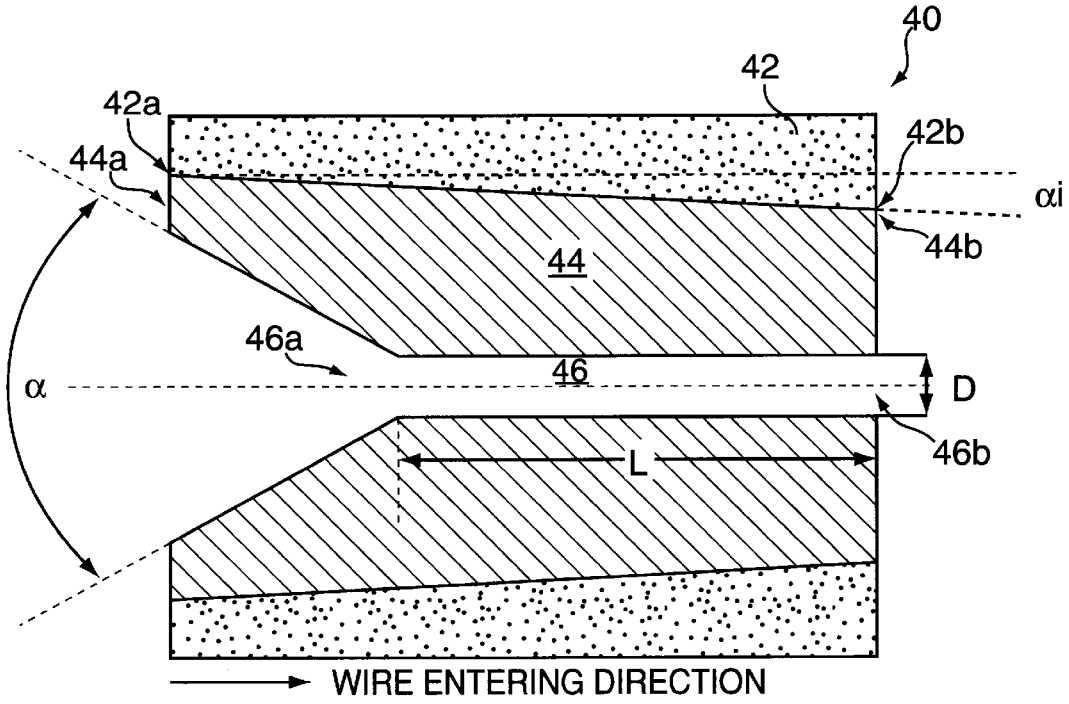
FIG. 6 is a cross-sectional view of a wire guide used in the brush stations of the embodiment of FIG. 2.

Wire guides 40 are positioned in front of and behind each pair of brushes 22*a*, 22*b*, 24*a*, 24*b*, as illustrated in FIG. 3, for guiding and supporting the wire rod 12 in contact the brushes. As shown in FIG. 6, the wire guides 40 preferably include a rigid and strong outer casting 42, surrounding a relatively softer and more resilient body 44, having a channel 46 formed therethrough. The channel 46 includes a funnel-shaped inlet 46*a* at one end for receiving wire and an outlet 46*b* at its other end through which the wire rod 12 exits the guide 40. Outer casting 42 is preferably formed of steel, to hold the body 44 together under high straightening pressure. The body 44 is preferably formed of a polymer material (for example, polyamide or polyimide) or wood (for example, pock-wood, a very hard wood from the Guaiacum tree). The length L of channel 46 is preferably equal to about ten times the diameter of the wire rod 12 and the diameter D of channel 46 and outlet 46*b* is preferably slightly larger than the diameter of the wire rod 12. The entrance angle α of inlet 46*a* is preferably about 45° to maximize incoming wire guidance and minimize any stress on the wire rod 12. Outer surface of the guide body portion 44 (and of its contact surface, the internal surface of the outer casting 42) are slightly conical, reducing in diameter towards the exit end 44*b*, to prevent the body 44 from being pulled out of its casing 42 by any frictional force between the wire rod 12 and the body 44. The angle $\alpha_i$ formed by the conical surface 44 to the axis of the channel, need be no greater than about 2°, to achieve the desired effect.

Thus, as wire rod 12 enters the inlet brush station 20 it is guided by the wire guides 40 between the first and the second pairs of brushes 22*a*, 22*b*, and 24*a*, 24*b*, respectively, which remove the oxide film from the surface of wire rod 12 while cleaning and activating the wire rod surface, prior to the coating step. Vacuum nozzles 30 in front of the first and second pairs of brushes 22*a*, 22*b*, 24*a*, 24*b* vacuum up any dust particles removed from the surface of wire rod 12 by this brushing step. This dry brush treatment step yields uniform surface treatment and a relatively low dry brush dust deposit for disposal. The resulting relatively small volume of dry brush dust that is sucked up by the vacuum nozzles 30 can be disposed of as non-hazardous material according to the applicable Material Safety Data Sheet (MSDS). In addition, it requires a relatively low initial investment and processing cost. Thus, the conventional pickling and mechanical scale removal steps and their attendant environmental waste hazards and costs are eliminated by the pre-drawing brushing step performed by the inlet brush station 20. Specifically, this dry brush treatment step does not require acid or gas or create any hazardous waste or waste water.

Figure 7:
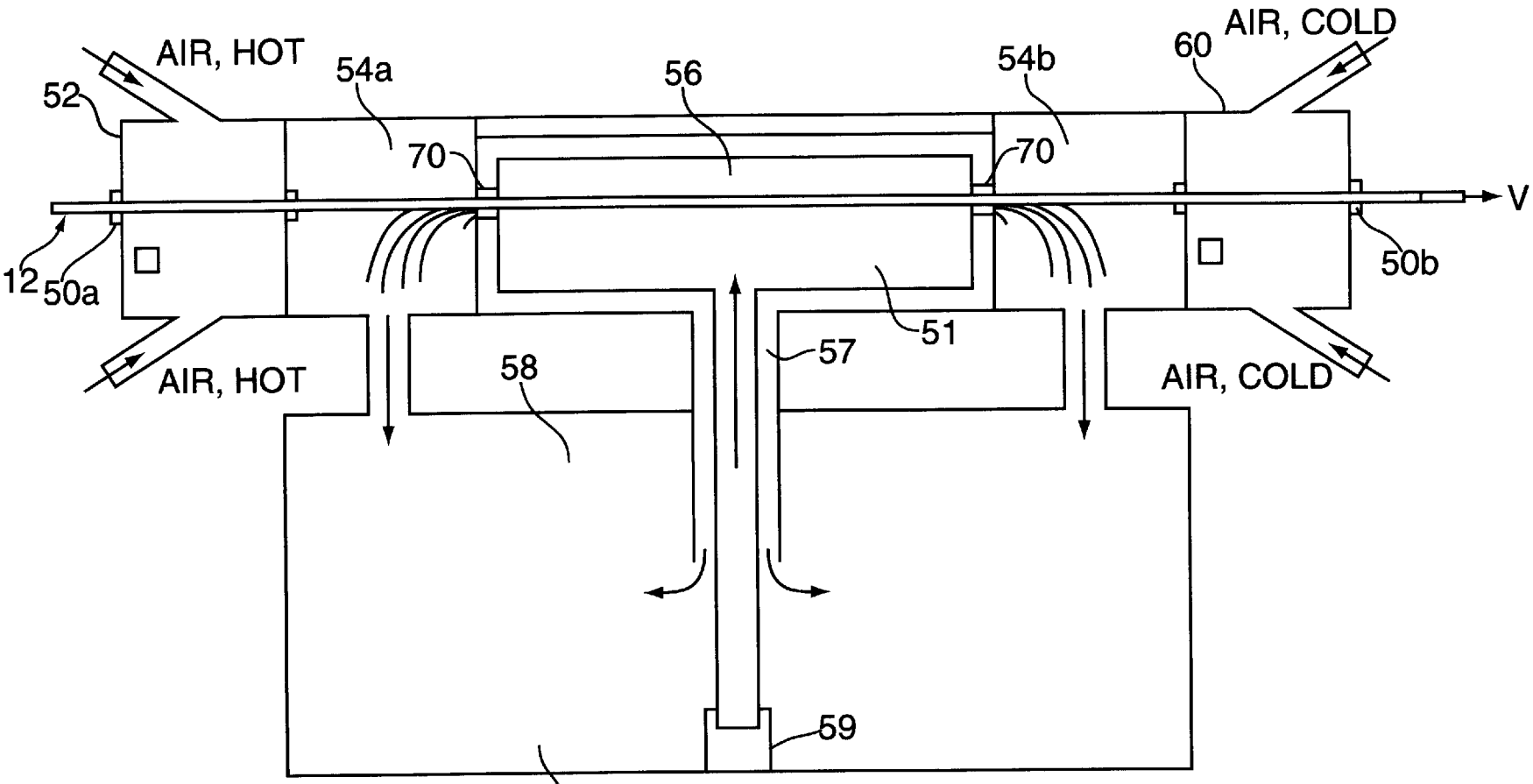
FIG. 7 is a schematic view of the coating device used in the embodiment of FIG. 2 of the process of this invention.

The wire rod 12 next passes from the inlet brush station 20 to a coating system 50, which performs a coating step during which a lubricant carrier coating 51 is applied to the surface of the wire rod 12, in preparation for application of dry lubricant during the drawing of the wire. As illustrated in FIG. 7, the coating system 50 includes an inlet 50*a* leading to preheating section 52, a first overflow basin 54*a*, a coating basin 56, an overflow channel 57 surrounding the coating basin 56 and extending down into a coating storage tank 58, a second overflow basin 54*b*, a blow-off section 60, an outlet 50*b* and wire guides 70; the first and second overflow basins 54*a*,, are each in fluid flow connection to the storage tank 58. An immersion pump 59 continuously pumps lubricant carrier coating solution 51 from coating storage tank 58 through inlet pipe 53 into the coating basin 56. The immersion pump capacity and drain sizes maintain a constant flow rate and bath temperature. Preferably, the immersion pump capacity is high enough to maintain a consistent coating bath concentration and constant bath level. Excess coating solution 51 drains through the overflow channels 57 and the first and second overflow basins 54*a*, 54*b*, back to the coating storage tank 58, preferably by gravity feed.

The preheating section 52 is preferably from about 200 to about 500 mm long and is maintained at a temperature of from about 100 to about 250° C. The wire rod 12 is passed through the preheating section 52 to heat the wire rod 12 to a temperature similar to that of the coating basin 56 for optimal coating adhesion to wire rod 12. The desired temperature is affected by the following three variables: amount of heat generated during the brushing step, preheating in preheating section 52 and the length of time during which wire rod 12 is in coating basin 56. Therefore, the optimum temperature for preheating section 52 must be determined in an empirical manner based on these variables.

The first and second overflow basins 54*a*, 54*b* are preferably about ⅓–½ of the length of the coating basin, have appropriate empty-volume to handle the flow of liquid, and are maintained at ambient temperature. The coating basin 56 is preferably from about 400 to about 1000 mm long and from about 100 to about 200 mm wide, the volume of coating contained therein is preferably a minimum of about 1 gallon, and the bath level in the coating basin 56 is preferably about as deep as the coating basin is wide. The coating storage tank 58 preferably has a volume of about 50–100 gallons.

The wire rod 12 enters the preheating section 52 of the coating device 50 through inlet 50*a*, passes through the preheating section 52 and the first overflow basin 54*a* to the coating basin 56 and then the second overflow basin 54*b*. As the wire rod 12 passes through the coating basin 56, it is immersed in the coating bath. As discussed above, an immersion pump 59 in the storage tank 58 continuously supplies coating solution from the coating storage tank 58 to the coating basin 56. Excess coating solution drains through the overflow system 57 and the first and second overflow tanks 54*a*, 54*b*, and is recycled to the coating storage tank 58 for reuse. The wire rod 12 passes from the second overflow basin 54*b* to the blow-off section 60, where cold air is circulated to blow off excess coating solution, to avoid the forming of drops; the coated wire rod 12 then exits the coating device 50 through the outlet 50*b*.

As illustrated in FIG. 7, wire guides 70 are preferably provided in the coating system 50 to support the wire rod 12 as it passes through; the wire guides 70 are located at the inlet 50*a*, outlet 50*b*, and between (1) the preheating section 52 and the first overflow basin 54*a*; (2) the first overflow basin 54*a* and the coating basin 56; (3) the coating basin 56 and the second overflow basin 54*b*; and (4) the second overflow basin 54*b* and the blow-off section 60.

Figure 8:
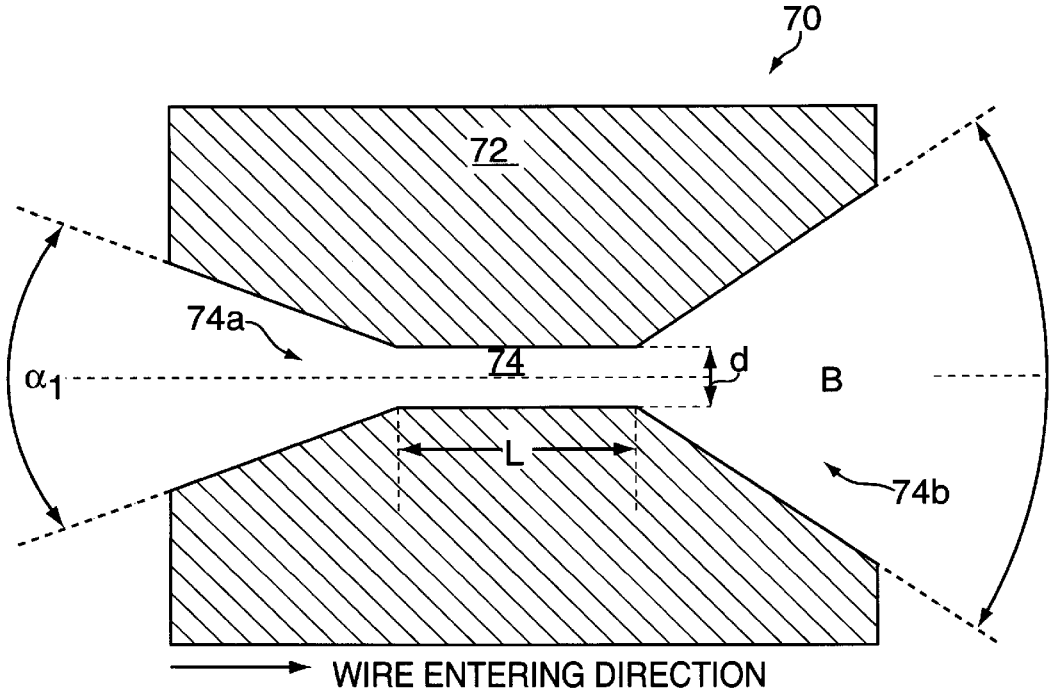
FIG. 8 is a cross-sectional view of a wire guide used in the coating device of this invention, shown in FIG. 7.

As illustrated in FIG. 8, wire guides 70 preferably include a guide body 72 having a channel 74 formed therein, a funnel-shaped inlet 74*a* located at one end for receiving wire rod 12, and a funnel-shaped outlet 74*b* located at its other end through which wire rod 12 exits the wire guide 70. The guide body 72 is preferably formed, so as to avoid wire damage, of a heat-resistant, resilient, polymeric plastic, such as a polyimide, or any other suitable resilient material. The length (l) of the channel 74 is preferably equal to at least about twice the diameter of the wire rod 12, and the diameter (d) of the channel 74 is only slightly larger than the diameter of the wire rod 12; that is, the diameter (d) of the channel 74 should be preferably about 0.5 to 1.0 mm greater than the diameter of the wire rod 12, to avoid removal of the coating and to limit the solution overflow. The entrance angle $\alpha$ of the inlet 74*a* is preferably about 20°, to maximize incoming wire rod guidance, and to direct the flow of lubricant carrier coating. The exit angle $\beta$ of the outlet 74*b* is preferably about 45° to provide maximum strength for the guide body by reducing the length of channel 74 and to avoid coating removal in channel 74 and at outlet 74*b*.

Substantially identical wire guides 70 may be used at all locations in coating device 50. Alternatively, wire guides 40 similar to those used in the inlet brush station 20 (illustrated in FIG. 3) may be used at the inlet 50*a* and between the preheater 52 and the first overflow basin 54*a*.

The lubricant carrier coating 51 may be any soluble coating, such as lime, or a soluble sulfate salt compound. The salt bath preferably is maintained at a temperature sufficient to provide a desired concentration of dissolved salt, below the boiling point of the bath, but high enough to avoid having to heat the wet wire rod too rapidly in the drier section. The concentration (as measured by the density of solution) of this type of lubricant carrier coating should be sufficient to provide a suitable coating on the wire rod surface, but not too high, so as to prevent precipitation of undissolved carrier salt from the bath. A thermometer (not shown) is provided in the coating basin 56 and electrical heater elements (not shown) are provided in the coating storage tank 58 to control the temperature of the lubricant carrier coating 56. The optimal temperature and concentration of the coating depends upon the coating composition. Lubricant carrier coating 51 allows improved adhesion of a dry drawing lubricant, such as calcium stearate, to the surface of the wire rod 12, which is normally used during the wire drawing step discussed below.

The coating salt bath solution is controlled using a density hydrometer. The ability to control the bath concentration allows the life of the coating bath to be extended over that for conventional methods. The flow rate of the coating solution within the coating device 50 is preferably about ½–10 gallon per minute in order to maintain a consistent coating bath concentration.

The coating device 50 is a significant improvement over conventional coating tanks, because it requires a relatively very small coating bath and, as a result, little coating residual waste relative to conventional coating tanks, and no waste water. Further, the coating system produces a uniform thin coating skin on wire rod 12, while avoiding any localized coating accumulations (drops) typically produced by conventional coating tank methods. In addition, it requires a relatively low initial investment and processing cost.

Once the wire rod 12 is coated, it passes from the coating device 50 to a dryer 80, where a drying step is performed to dry the coating applied in the coating system 50. The dryer 80 preferably comprises two pairs of concentric steel pipes (not shown), each having a length, depending on the dryer capacity, of from about 1500 mm to about 2500 mm, an inner diameter of from about 50 to about 100 mm and an outer diameter of from about 200 to about 300 mm. An insulating material (not shown) is preferably inserted between the inner and outer diameters of the steel pipe. An electrical air dryer (not shown) is provided at the exit end of the dryer 80, so that it blows air into the pipe in a direction opposite that of motion of the wire rod 12.

The wire rod 12 is then passed from the dryer 80 to a cooler 100, which performs the step of cooling the wire rod 12. The cooler 100 preferably comprises a steel pipe (not shown) having a length of from about 1500 to about 2500 mm and an inner diameter of from about 50 to about 100 mm. Electrical air blowers (unheated and not shown) are provided at the exit end of the cooler 100 so that they blow air into the pipe in a direction countercurrent to the motion of the wire. Preferably, the temperature of the cooler 100 is ambient temperature. Wire temperature control for the cooler 100 is provided by a contact thermometer. The wire rod 12 should be cooled to a temperature of less than the lubricant melting point. The dryer 80 and cooler 100 require relatively low initial investment and processing costs and allow for continuous treatment of wire 12.

Once the wire rod 12 is cooled in the cooler 100, the wire rod is pass to the first drawing capstan, where a dry powdered lubricant, such as a soap of an alkali metal or alkaline earth-metal, is applied to the wire rod, in a soap chamber, and adheres to the coating; the wire is then drawn through the first capstan of the drawing machine 120. Drawing machine 120 may be any conventional drawing machine suitable for the type of wire 12 being drawn, such as a standard 11-capstan straight line multiple drawing machine. In the usual case, a soap chamber is provided prior to each capstan. The appropriate drawing machine is selected by considering, among other factors, the material to be drawn, the inlet and respective final outlet wire size, and the desired finish.

Drawn wire rod 12 exiting the drawing machine 120 enters a first outlet brush station 140, containing a cascade of brushes, which perform the step of removing residual surface coating compounds (coating plus lubricant) from the surface of the drawn wire rod 12, then passes from the first outlet brush station 140 to a second outlet brush station 160, which removes any residual coating compounds (carrier coating plus lubricant) from the drawn wire rod 12.

Preferably, the first and second outlet brush stations 140, 160 each include first and second pairs of brushes 122*a*, 122*b*, 124*a*, 124*b*, 222*a*, 222*b*, 224*a*, 224*b*, vacuum nozzles 130 and wire guides 140 all located in relation to each other and to the drawn wire rod 12 in an arrangement similar to that described above and illustrated in FIGS. 3 and 4 for the inlet brush station 20. Preferably, the brushes 122*a*, 122*b*, 124*a*, 124*b* in the first and second outlet brush stations 140, 160 each include drive axles 126, bodies 128 and bristles 128*a* extending radially outwardly from each body 128, as described above and shown in FIG. 4 for brushes 22*a*, 22*b*, 24*a*, 24*b* in inlet brush station 20. Because the drawn wire 12 has higher tensile strength as it passes through the first and second outlet brush stations 140, 160 than did the undrawn wire rod 12 in the inlet brush station 20, and the first and second outlet brush stations 140, 160 only perform a cleaning step, the bristles of the brushes used in the outlet brush stations 140, 160 should be thinner than those for the brushes used in the inlet brush station 20, and possibly a slight variation in hardness. Preferably, the brushes 122*a*, 122*b*, 124*a*, 124*b*, 222*a*, 222*b*, 224*a*, 224*b*, used in the first and second outlet brush stations 140, 160, meet the following parameters: brush revolution speed of about 2400 to 12000 rpm; brush outside diameter of about 40 to 200 mm; face width $F_w$ of about 10 to 40 mm; bristle length $T_L$ of about 5 to 50 mm; bristle diameter of about 0.15 to 0.4 mm; and bristle hardness of approximately half to full hard.

Thus, the first and second outlet brush stations 140, 160 can be sufficiently effective in cleaning the drawn wire, that it can substantially eliminate the need for conventional degreasing methods and their attendant hazardous waste and economic cost. Specifically, the first outlet brush station 140 removes a major portion of the residual coating compound, and the second outlet brush station 160 removes the final coating residual compound. The resulting residual compound removal rate is greater than about 95%. The first and second outlet brush stations 140, 160 thus can reduce or eliminate the need for conventional chemical degreasing tanks or existing degreasing lines. As discussed above in relation to inlet brush station 20, the resulting dry brush dust is of even relatively lower volume and is non-hazardous, and there is no waste water, acid or gas; this allows for easy, non-hazardous disposal of residual compounds. This dry brush treatment step also yields uniform surface treatment and requires relatively low initial investment and processing costs.

After the drawn wire rod 12 exits the second outlet brush station 160, it passes to a wire take-up 200. Wire take-up 200 is a conventional wire take-up, such as a stripper block or a spooler, for winding the drawn wire on stripper blocks or spoolers, respectively, for shipping or further processing.

The following is a specific preferred embodiment of the present invention. It is intended as exemplary only and not intended to define the limits of this invention.

EXAMPLE

Stainless steel wire is treated under the continuous in-line dry brush and coating treatment process of this invention, using a system in accordance with the attached drawings.

The wire to be drawn according to this example is grade AISI 302 stainless steel wire rod having a diameter of 5.5 mm and a wire tensile strength of 645 N/mm$^2$. Its chemical composition is as follows:

0.104% carbon (C);

0.99% silicon (Si);

1.31% manganese (Mn);

0.02% phosphorous (P);

0.0087% sulfur (S);

17.16% chromium (Cr); and 8.15% nickel (Ni).

The wire rod has a hot rolled, pre-pickled, passivated finish, as received from the raw material supplier.

The invention system 10 described above is used to draw the stainless steel wire. The roll straightener is a standard straightener with 5 straightener rolls each having a roll diameter of 80 mm. The redirecting wheel has a diameter of 560 mm×80 mm and was made of Pertinax. Bodies 44 of the wire guides 40 are made of pock-wood. A 2,000 pound spooler is used as a wire take-up 200. The longitudinal wire speed through the wire pay off 14, the inlet brush station 20, the coating device 50, the dryer 80, the cooler 100 and at the inlet to the drawing machine 120, was about 1.5 m/sec.

The four brushes 22*a*, 22*b*, 24*a*, 24*b*, at the inlet brush station 20, have the following properties:

Brush outside diameter: 250 mm;

Brush face width: 50 mm;

Bristle trim length: 55 mm;

Bristle diameter: 0.50 mm;

Bristle shape: crimped stainless steel wire;

Bristle hardness: 55 HRC; and

Brush speed of rotation: 3,000 rpm.

The composition of the bristles 28*a* of the brushes 22*a*, 22*b*, 24*a*, 24*b* is as follows:

0.094% C;

0.812% Si;

1.239% Mn;

0.003% S;

17.3% Cr; and 8.12% Ni.

The brush effect for brushes 22*a*, 22*b*, 24*a* and 24*b* of inlet brush station 20 is adjusted for maximum oxide film removal by setting the I (idle) current draw of the brush motor at 5 amps and the L (load) current draw at 7.5 amps, adjusted with a pneumatic pressure of about 4.5 bars.

The vacuum nozzles 30 have an opening diameter of about 40 mm and provide a vacuum level of about 290 mbars.

The immersion pump capacity and drain sizes maintain a constant flow rate of about 8 gal. per minute, and a constant bath temperature.

The preheating section 52 is about 200 mm long and is maintained at a temperature of about 200° C.

The first and second overflow basins 54*a*, 54*b* are about 200 mm in length, have a volume of about 0.5 gal., and are maintained at ambient temperature. The coating basin 56 is about 400 mm long and 100 mm wide, the volume of coating contained therein is about 1 gallon, and the bath level in the coating basin 56 is about 100 mm in depth. The coating storage tank 58 has a volume of about 70 gallons. The salt bath is maintained at a temperature of about 90° C.; the concentration (as measured by the density of solution) of this type of lubricant carrier coating is equal to 1.18 g/cm$^3$ at 20° C.

The flow rate of the coating solution within the coating device 50 is about 8 gallon per minute, in order to maintain a consistent coating bath concentration.

The two pairs of concentric steel pipes (not shown), forming the dryer 80, having insulation between them, each have a length of about 1600 mm, an inner diameter of about 75 mm and an outer diameter of about 300 mm. The electrical air dryer blows air into the pipe at a temperature of about 420° C. at the entry end, and the air exits (at the wire inlet) at a temperature about 225° C.; the dryer 80 has a heater capacity of about 8 kW.

The cooler 100 steel pipe has a length of about 1800 mm and an inner diameter of about 75 mm. The temperature of the air in the cooler 100 is approximately ambient temperature and the two air blowers have a capacity of about 0.25 kW. The wire rod 12 is cooled to a temperature of less than about 65° C.

The lubricant, calcium stearate (a soap) having a melting point of about 150° C. is applied immediately upstream of each drawing unit. Using a standard 11-capstan straight line multiple drawing machine, and starting with a 5.5 mm wire rod diameter, at an inlet speed of approximately 1.5 m/sec and an outlet speed of approximately 8.5 m/sec, the drawing reduction schedule set forth in Table I is followed.

TABLE I

DRAWING REDUCTION SCHEDULE FOR A STANDARD 11-CAPSTAN STRAIGHT LINE MULTIPLE DRAWING MACHINE

| CAPSTAN LOCATION | ROD DIAMETER (mm) |
|---|---|
| First Capstan | 4.980 |
| Second Capstan | 4.510 |
| Third Capstan | 4.110 |
| Fourth Capstan | 3.745 |
| Fifth Capstan | 3.430 |
| Sixth Capstan | 3.145 |
| Seventh Capstan | 2.900 |
| Eighth Capstan | 2.675 |
| Ninth Capstan | 2.480 |
| Tenth Capstan | 2.480 |
| Eleventh Capstan | 2.30 |

Wire rod 12 is drawn through pressure and rotating die assemblies. The final wire tensile strength is about 1982 N/mm$^2$.

The four brushes 122*a*, 122*b*, 124*a*, 124*b* at the first outlet brush station 140 are defined by the following parameters:

Brush outside diameter: 125 mm;

Brush face width: 30 mm;

Trim length: 30 mm;

Bristle diameter: 0.35 mm;

Brush speed of rotation 3500 rpm;

Bristle shape: crimped stainless steel wire; and

Bristle hardness: 54 HRC.

Bristles for the brushes 122*a*, 122*b*, 124*a*, 124*b* used in the first outlet brush station 140 have the following composition:

0.107% C;

0.92% Si;

1.17% Mg 0.0037% S 18.78% Cr; and 8.90% Ni.

The brush effect for brushes 122*a*, 122*b*, 124*a* and 124*b* of first outlet brush station 140 are adjusted for maximum oxide film removal by setting the I (idle) current draw of the brush motor at 0.6 amp and the L (load) current draw at approximately 1 amp, adjusted with a pneumatic pressure of about 3 bars.

The brushes 222*a*, 222*b*, 224*a*, 224*b* at the second outlet brush station 160 are defined by the following parameters:

Brush outside diameter: 125 mm;

Brush face width: 30 mm;

Trim length: 30 mm;

Bristle diameter: 0.30 mm;

Brush rotational speed: 3500 rpm;

Bristle shape: crimped stainless steel wire; and

Bristle hardness: 53 HRC.

The brushes 222*a*, 222*b*, 224*a*, 224*b* of the second outlet brush station 160 had the following composition:

0.036% C;

0.6% Si;

1.20% Mn;

0.0047% S;

17.63% Cr; and 9.2% Ni.

The brush effect for the brushes 22*a*, 22*b*, 24*a* and 24*b* of the second outlet brush station 160 are adjusted for maximum oxide film removal by setting the I (idle) current draw of the brush motor at 0.6 amp and the L (load) current draw at approximately 1 amp, adjusted with a pneumatic pressure of about 3 bars.

Vacuum nozzles 130 and the vacuum(s) (not shown) used at the first and second outlet brush stations 140, 160 each preferably have a diameter of 35 mm and a vacuum level of about 220 mbar.

Modifications and variations of the above-described embodiments of the present invention are possible, as appreciated by those skilled in the art in light of the above teachings. For example, circular or cup brush systems or additional pairs of brushes could be added to inlet brush station 20, first outlet brush station 140 and/or second outlet brush station 160 so that six or more brushes are used in any given brush station to perform the pre- and post-drawing dry brushing steps.

It is therefore to be understood that, within the scope of the appended claims and their equivalents, the invention may be practiced otherwise than as specifically described.

What is claimed is:

1. A continuous in-drawing line treatment process for drawing stainless steel wire rod and wire comprising:

brushing the surface of the stainless steel wire to remove oxide film therefrom to form cleaned stainless steel wire;

coating the cleaned stainless steel wire with a lubricant carrier coating to form coated stainless steel wire;

drying the coated stainless steel wire to form dried, coated stainless steel wire;

cooling the dried, coated stainless steel wire to form cooled, coated stainless steel wire;

applying a dry lubricant to, and drawing the cooled, coated stainless steel wire through a drawing machine with the dry lubricant adhered to the wire coating, to form drawn stainless steel wire having residual dry lubricant and coating on the surface thereof; and brushing the surface of the drawn stainless steel wire to remove the residual dry lubricant and coating therefrom.

2. A continuous in-drawing line treatment system for drawing stainless steel wire comprising:

an inlet brush station for brushing the surface of the stainless steel wire to remove oxide film therefrom to form cleaned stainless steel wire;

a coating device for coating the cleaned stainless steel wire with a lubricant carrier coating to form a coated stainless steel wire;

a dryer for drying the lubricant carrier coating on the coated stainless steel wire to form dried, coated stainless steel wire;

a cooler for cooling the dried, coated stainless steel wire to form cooled, coated stainless steel wire;

drawing machine for applying a dry lubricant to, and drawing the cooled, lubricant-coated stainless steel wire to form drawn stainless steel wire having residual drawing compounds on the surface thereof; and an outlet brush station for brushing the surface of the drawn stainless steel wire to remove the residual drawing compounds therefrom.

3. A continuous in-line process for the drawing reduction of stainless steel wire rod comprising the steps of (1) providing stainless steel wire rod from a continuous wire payoff to an inlet brush station, the brush station comprising at least four rotating brushes having stainless steel bristles, the bristled face of each brush being in contact with the surface of the longitudinally moving stainless steel wire rod and the ends of the stainless steel brush bristles being pressed against the stainless steel wire rod; (2) mechanically removing dry oxide film from the stainless steel wire rod by passing the stainless steel wire rod through the inlet brush station in contact with the ends of the brushes' stainless steel bristles; (3) coating the stainless steel wire rod with a lubricant carrier coating by passing the stainless steel wire rod continuously through a coating bath solution; (4) passing the coated stainless steel wire rod through a dryer to dry the coating; (5) cooling the dry, coated stainless steel wire rod; (6) applying a dry lubricant powder so that it adheres to the coated stainless steel wire rod; (7) drawing the lubricant-coated stainless steel wire rod through a series of dies in a drawing machine to form a drawn stainless steel wire having a reduced diameter; (8) removing a substantial portion of any residual lubricant coating from the surface of the drawn stainless steel wire by passing the drawn stainless steel wire through a first outlet brush station comprising at least four rotating medium stainless steel bristle brushes, the bristles of each brush being pressed against the surface of the stainless steel wire; (9) removing substantially all of the remaining residual lubricant coating and any impurities from the surface of the drawn stainless steel wire by passing it through a second outlet brush station comprising at least four rotating stainless steel bristle brushes, the stainless steel bristles of each brush being relatively finer than the bristles on the inlet brushes pressed against the surface of the wire; and (10) passing the drawn, cleaned stainless steel wire to a conventional wire take-up device.

4. The continuous in-line process of claim 3, further comprising, prior to passing the stainless steel wire through the coating bath, the step of pre-heating the continuously moving stainless steel wire rod in a preheater maintained at a temperature of at least about 100° C.

5. The continuous in-line process of claim 3, wherein the coating bath solution is an aqueous solution.

6. The continuous in-line process of claim 3, further comprising, after passing the stainless steel wire through the coating bath and before applying the lubricant, subjecting the coated and dried stainless steel wire rod to flowing ambient air, to cool the stainless steel wire rod to below the melting point of the lubricant.

7. The continuous in-line process of claim 3, further comprising pressing the stainless steel wire against the rotating brushes so that the effectiveness of the brushing to remove the surface film or coatings is improved.

8. The continuous in-line process of claim 3, wherein the stainless steel wire rod is continuously passed through a longitudinally extending bath, and the bath is continuously being circulated in order to maintain a substantially constant concentration and temperature.

9. The continuous in-line process of claim 3, wherein the stainless steel bristles of the brushes are formed of a material galvanically similar to the material of the stainless steel wire rod.

* * * * *